US006493968B2

(12) United States Patent
Chinitz

(10) Patent No.: US 6,493,968 B2
(45) Date of Patent: Dec. 17, 2002

(54) FRAME APPARATUS AND METHOD FOR STRETCHING FLEXIBLE MATERIAL

(76) Inventor: Clyde J. Chinitz, 117 Pacific St., Brooklyn, NY (US) 11201

( * ) Notice: Subject to any disclaimer, the term of this patent is extended or adjusted under 35 U.S.C. 154(b) by 0 days.

(21) Appl. No.: 09/758,905

(22) Filed: Jan. 11, 2001

(65) Prior Publication Data

US 2001/0047602 A1 Dec. 6, 2001

Related U.S. Application Data

(60) Provisional application No. 60/175,492, filed on Jan. 11, 2000, and provisional application No. 60/220,766, filed on Jul. 24, 2000.

(51) Int. Cl.[7] ..... D06C 3/08
(52) U.S. Cl. ..... 38/102.91
(58) Field of Search ..... 38/102.91, 102.4, 38/102.1; 160/371, 378, 380, 395, 398, 399

(56) References Cited

U.S. PATENT DOCUMENTS

| | | | | |
|---|---|---|---|---|
| 2,218,451 A | | 10/1940 | Heyne | |
| 2,456,225 A | * | 12/1948 | Thomas | 38/102.91 |
| 3,211,089 A | | 10/1965 | Messerschmitt | |
| 3,255,540 A | * | 6/1966 | Gilman | 38/102.91 |
| 3,359,663 A | * | 12/1967 | Black | 38/102.91 |
| 3,553,862 A | | 1/1971 | Hamu | |
| 3,914,887 A | | 10/1975 | Newman | |
| 3,950,869 A | * | 4/1976 | Samarin | 38/102.91 |
| 4,097,968 A | * | 7/1978 | Pikus | 38/102.91 X |
| 4,265,039 A | | 5/1981 | Brooks | |
| 4,277,901 A | | 7/1981 | Williams | |
| 4,317,301 A | | 3/1982 | Timphony et al. | |
| 4,451,997 A | | 6/1984 | Jones | |
| 4,660,308 A | | 4/1987 | Dang et al. | |
| 4,724,761 A | | 2/1988 | Bubley | |
| 5,033,529 A | | 6/1991 | Koschade | |
| 5,222,314 A | | 6/1993 | Inteso | |
| 5,287,640 A | | 2/1994 | Morgan | |
| 5,293,704 A | | 3/1994 | Brown | |
| 5,355,792 A | | 10/1994 | MacNaughton et al. | |
| 5,493,800 A | | 2/1996 | Chinitz | |

* cited by examiner

*Primary Examiner*—Ismael Izaguirre
(74) *Attorney, Agent, or Firm*—Dilworth & Barrese, LLP

(57) ABSTRACT

A frame apparatus and method of stretching a flexible material over a frame apparatus. The frame apparatus includes a first frame assembly positioned adjacent a second frame assembly for relative movement to stretch a material positioned over the first frame assembly and attached to the second frame assembly. One preferred embodiment repositions the first frame assembly defining a first plane parallel to the second frame assembly defining a second plane in a direction approximately perpendicular to the second frame. A further preferred embodiment includes the second frame assembly positioned on a rear side of the first frame assembly. The first frame assembly and second frame assembly having a spreading mechanism for increasing the distance between at least part of the first frame assembly from at least part of the second frame assembly. A method for stretching a flexible material over the frame apparatus includes positioning the material over the first frame and attaching it to the second frame and increasing the distance between at least part of the first frame assembly from at least part of the second frame assembly to adjustably stretch the material.

13 Claims, 4 Drawing Sheets

FRAME APPARATUS AND METHOD FOR STRETCHING FLEXIBLE MATERIAL

CROSS REFERENCE TO RELATED APPLICATIONS

The present application claims priority to U.S. Provisional Application Ser. No. 60/175,492 filed Jan. 11, 2000 and U.S. Provisional Application Ser. No. 60/220,766 filed Jul. 24, 2000, the entire contents of each of these applications is hereby incorporated by reference.

BACKGROUND

1. Technical Field

The present disclosure relates to apparatus and method for stretching flexible material and more particularly for stretching flexible material over a rigid frame.

2. Description of Related Art

It is known to attach flexible material to a single frame apparatus. In such apparatus the material is placed on the frame and wrapped around the back where the material is attached to the frame by way of suitable known fasteners such as staples, grommets, hook and loop fasteners or the like. The prior method requires creating virtually equal tension at every point of attachment as the connection between the material and the frame is made.

One disadvantage with the previous method is that equal tension must be measured at every attachment point in order to avoid creating wrinkles of excess material at any point around the frame.

Another disadvantage of the prior method is that it requires numerous attachment points between the frame and the material in order to achieve uniform stretching of the material about the frame. The attachment mechanisms are devices utilizing complex hardware and are distracting to use for displaying applications.

A still further disadvantage of the prior method is that it is not possible to view the front of the material being stretched about the frame during the attachment process. That is, during attachment, the user must turn the frame to the reverse side, stretch the material and apply the fastener, all without the benefit of viewing the effects on the front of the material as it is being attached.

SUMMARY

The present disclosure provides a frame apparatus and method of stretching a flexible material over a frame apparatus which overcomes the above noted disadvantages of the previous apparatus and methods. In a preferred embodiment, the presently disclosed frame apparatus requires no work at attachment points because the tension is created after the material is "hung" on the frame. This embodiment requires many fewer attaching points than does mounting material on a conventional single frame unit. In a further preferred embodiment, the presently disclosed apparatus is connected to a plate, the plates then slidably positioned on the frame and adjusted for tension utilizing a spreading mechanism.

One advantage of the presently disclosed apparatus and method is that the material can be attached and removed easily from the frames.

Another advantage of the presently disclosed frame apparatus and method is that it is possible to observe the face of the canvas as tension is created in the material. In addition, the hardware attaching the material to the frame apparatus is concealed or minimized to reduce its ability to be viewed from the first side of the apparatus.

BRIEF DESCRIPTION OF THE DRAWINGS

Preferred embodiments of the presently disclosed frame apparatus and method of stretching flexible material are described herein with reference to the drawings, wherein.

DETAILED DESCRIPTION OF PREFERRED EMBODIMENTS

Figure 1:
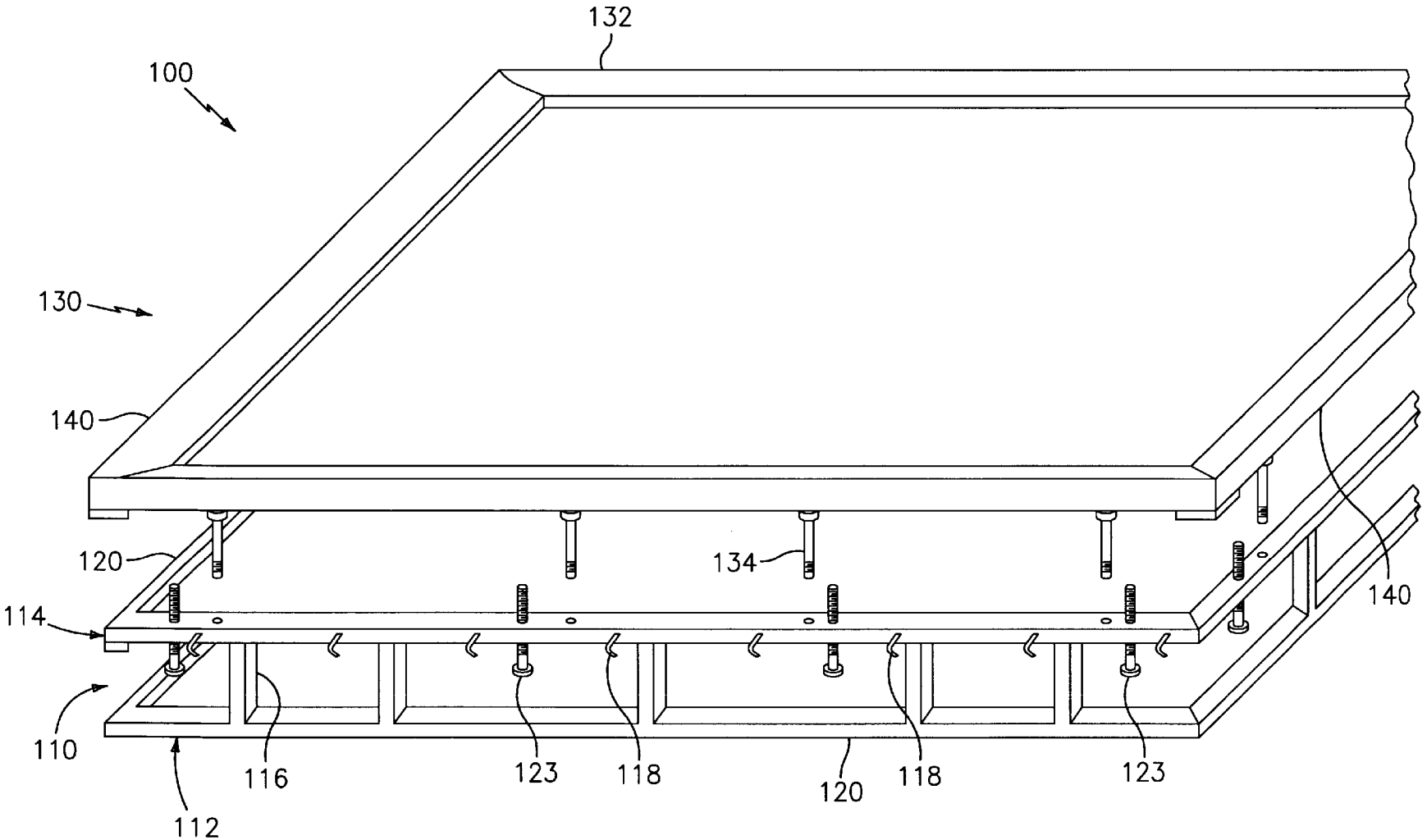
FIG. 1 is a partial perspective view of a first embodiment of a frame apparatus constructed in accordance with the present disclosure.
Figure 2:
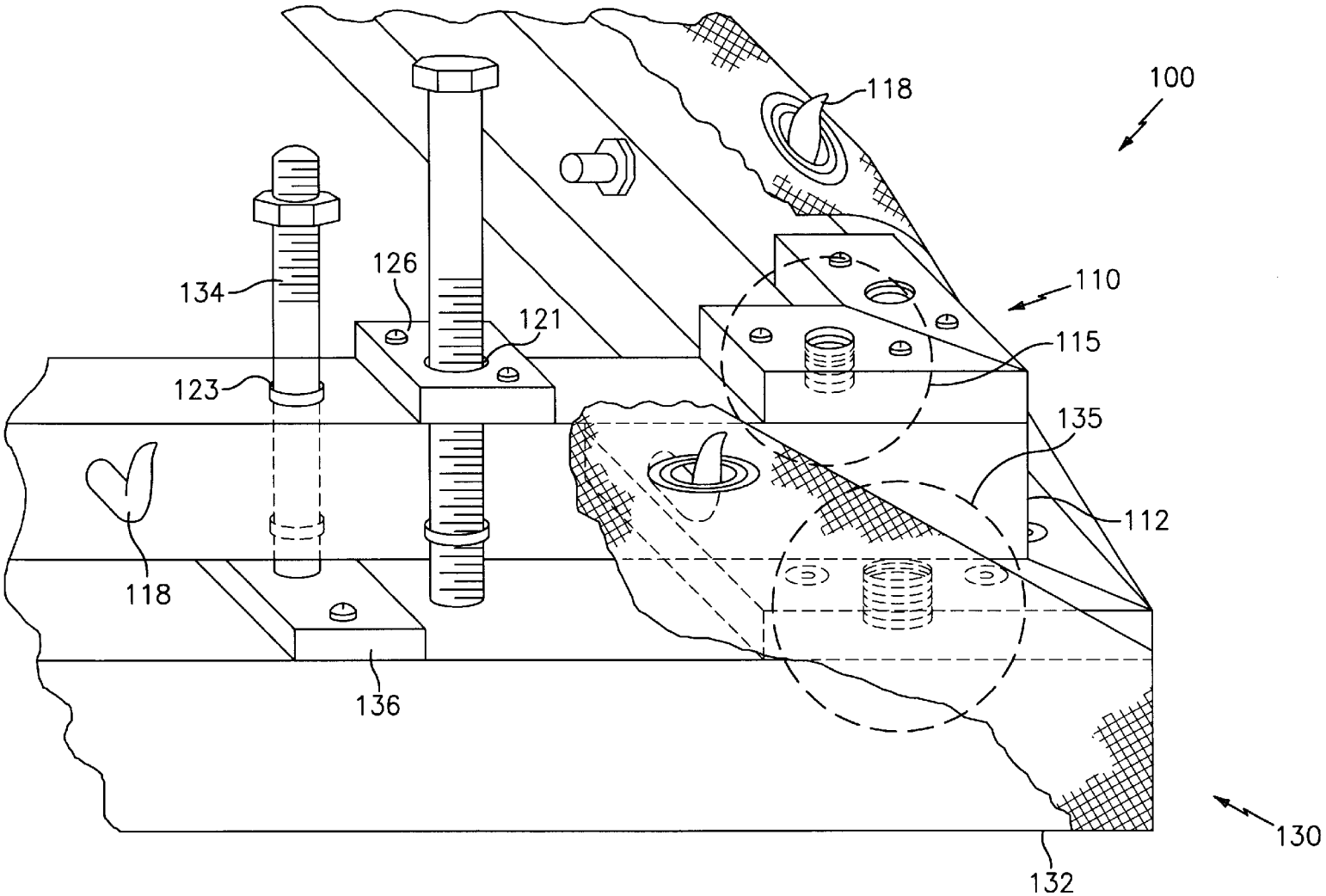
FIG. 2 is an enlarged partial perspective view showing a spreading mechanism of the embodiment of FIG. 1.

Referring to the drawings in detail and initially to FIGS. 1–2, a frame apparatus 100 for stretching flexible material over a rigid frame is shown configured as an adjustable structure for stretching flexible material. Examples of commonly used flexible materials are woven goods such as cotton, linen, nylon, vinyl latex and other rubber, or plastic sheeting material. It is to be understood as within the scope of the present disclosure that virtually any flexible sheet material may be used on the frame apparatus.

In one preferred embodiment, frame apparatus 100 includes a first frame 110 and a second frame 130. Frames 110 and 130 include a plurality of frame members 120 and 140 respectively. Frame 130 is the face frame onto which the flexible material must be mounted without wrinkles or puckers or sags. Frame 110 is positioned behind frame 130. As shown in FIG. 2, the material to be mounted is positioned relative to frames 110 and 130 such that edges of the material wrap around frame 130 and at least a portion of frame 110 and are attached by any suitable technique such as, for example, hooks 118 and grommets positioned on the flexible material. Hooks 118 are shown extending from a side of frame 110, but they may be recessed, for example, in frame 110 to minimize their ability to be seen. Frames 110 and 130 are preferably provided with adjustable bearing mechanisms 115 and 135 for adjustably moving frame members 120 and 140 respectively. A suitable bearing mechanism is disclosed in applicant's previously issued U.S. Pat. No. 5,493,800 issued Feb. 27, 1996, the entire contents of which are hereby incorporated by reference.

Once the material is attached to frame 110 the material may be stretched as desired by separating or creating distance between frame 110 and 130. In this manner, frame 130 is effectively pushed away from frame 110 and into the material thereby uniformly stretching the material about frame 130. Frame 110, in one preferred configuration includes a first sub-frame 112 and a second sub-frame 114 interconnected by support members 116 in one preferred embodiment. Frame 110 can take any suitable configuration, depending upon its material of construction, to ensure the proper structural support is provided for displaying the desired material and preclude warping or undesirable distortions in frames 110 and 130.

The drawings illustrate one particular embodiment of a spreading mechanism to selectively adjust the distance between frames 110 and 130. In particular, a bias member, such as a threaded bar 121 passing through a nut 126 and the frame 110 where nut 126 is fixed to frame 110. However, other suitable methods may also be used to create and maintain the distance between frames 110 and 130 required to "stretch" the material to a satisfactory tautness. For example, it is envisioned that one may also utilize cam members in conjunction with spreading members or other suitable adjustable spreading techniques.

An additional feature illustrated in the drawings is a post 134 which serves to stabilize frame 130 in relation to frame 110 so that when tension is being created by the frames separating no warping or twisting occurs in the frame. Post 136 is received by a nut 136 surrounding a hole 123 defined in frame 110 and is a safety precaution. The material may create additional stability in the frames when symmetrical and sufficient tension is achieved.

Figure 3:
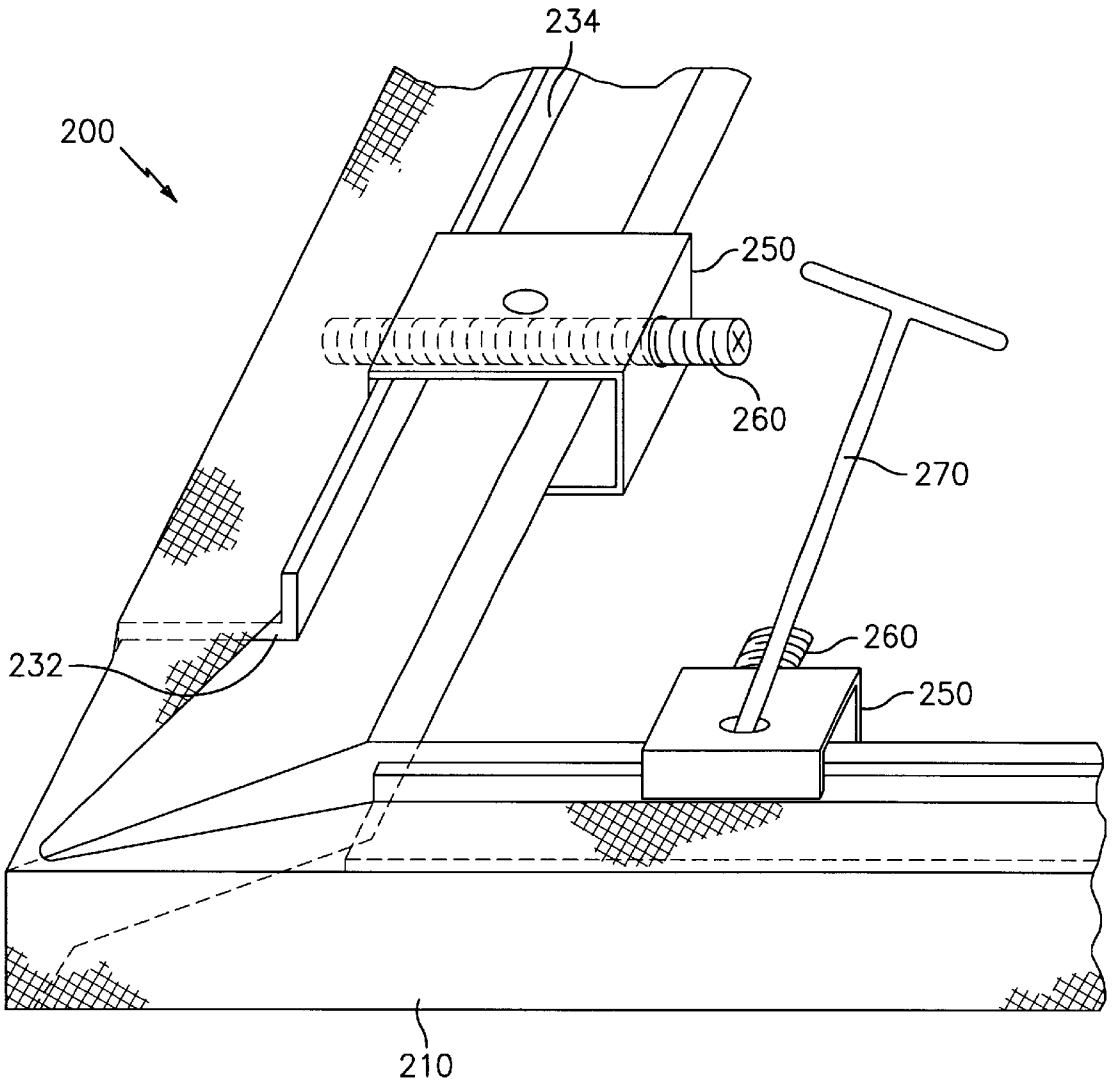
FIG. 3 is a partial perspective view of a second embodiment of the frame apparatus constructed in accordance with the present disclosure.
Figure 4:
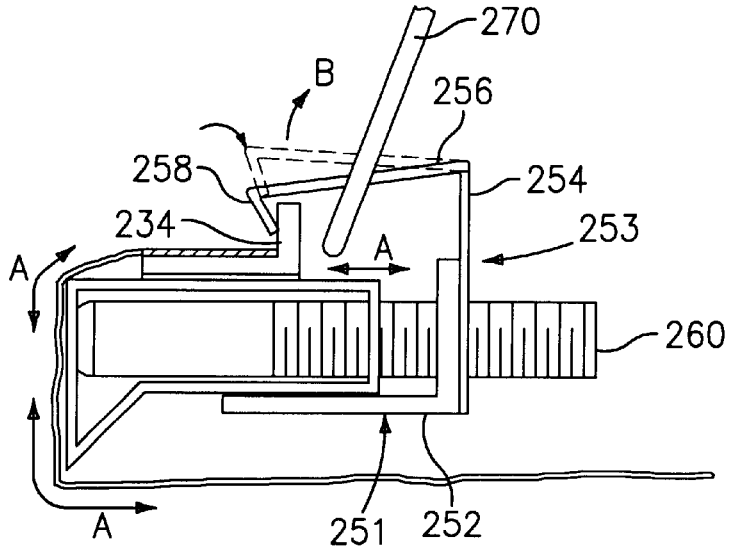
FIG. 4 is a cross-sectional view which shows a spreading mechanism for the embodiment of FIG. 3.
Figure 5:
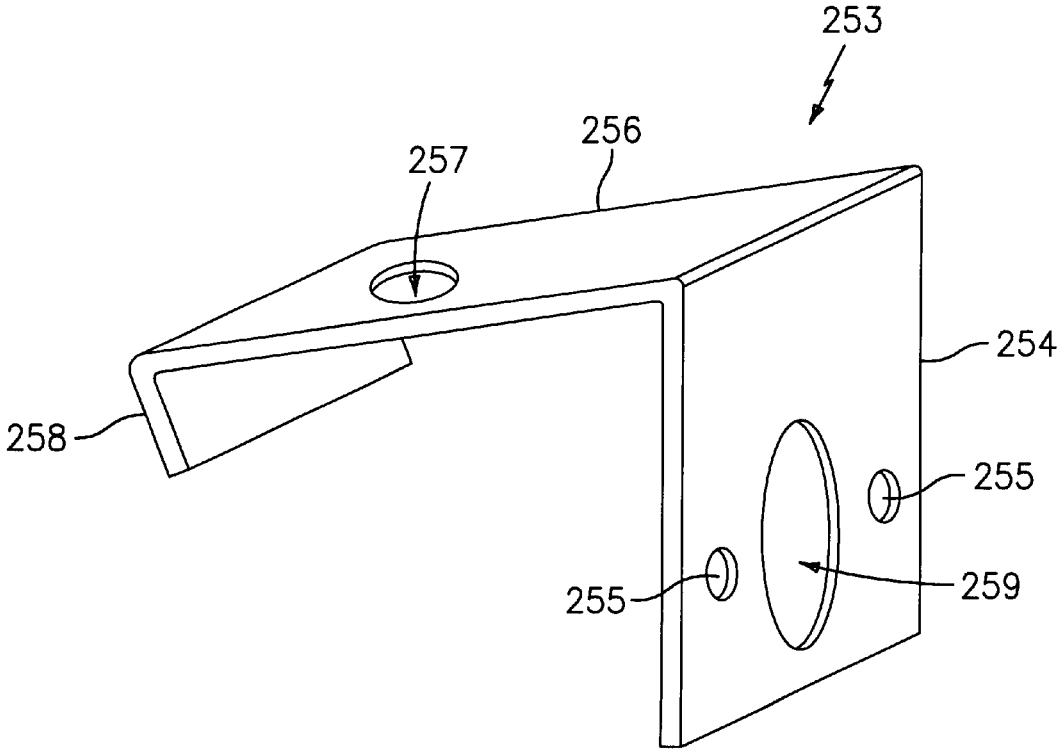
FIG. 5 is an enlarged perspective view a portion of a clip of the spreading mechanism of FIG. 4.

Referring now to FIGS. 3–5, in a second preferred embodiment, the flexible material is mounted on a frame apparatus 200 and preferably without wrinkles or puckers or sags. Frame apparatus 200 includes a first frame assembly 210 having a plurality of members and a second frame assembly 230 having a plurality of plates 232. For clarity and simplicity only one corner of frame apparatus 200 is illustrated in FIG. 3. The remaining corners of frame apparatus 200 are identical and, therefore will not be described in detail herein.

First frame assembly 210 includes a front side 210*a* and a rear side 210*b*. The flexible material is stretched over the front 210*a* of first frame assembly 210 and attached to flat plate members 232 of frame assembly 230 slidably positioned on the rear side 210*b* of first frame assembly 210. This visually conceals the attaching of the flexible material with second frame assembly 230. Each plate member 232 has a flange 234 formed thereon to facilitate stretching of the sheet material. Plate members 232 of second frame assembly 230 are preferably removable and reusable and may be formed of rigid material, for example, flat aluminum strips which are attached to the canvas or sheet material around the perimeter by way of any suitable known techniques, for example, loop and fastener connectors, or a pole-pocket made from a fold in the sheet material sewn to form a pocket around the perimeter. In the pole-pocket method, the strips are inserted in the pocket. Alternatively, the material can simply be wrapped around second frame assembly 230.

Clips or retaining members 250 also function as a part of a spreading mechanism. In one preferred embodiment, clips 250 have a first portion 251, preferably an angle iron or plate 252 having a flange that is connected with second portion 253 formed of a flexible material, for example, spring steel having a base plate 254 and a flange 256 having a latch or angled second flange 258. Flange 256 is configured to be positioned over flange 234. Base plate 254 defines a first hole 259 and a pair of second holes 255. Adjustable clips 250 are mounted on and removable from frames 210 and 230 with the aid of a T-shaped lever 270 positioned through hole 257 defined in flange 256 to position latch 258 onto flange 232 to stretch the material around frames 210 and 230. Lever 270 enables application of a force in the direction of arrow "B" for moving or flexing flange 256 over flange 234. Any suitable adjustment member or mechanism may be utilized to adjust the relative position of each plate members 232 with clips 250. For example, as shown, a threaded member such as rod 260, enables movement of clip 250 toward or away from the outer edge of frame 210 so as to move plate member 232 in a direction generally parallel to the front side of the first frame assembly and the flexible material mounted thereon.

The drawings illustrate one particular embodiment of a spreading mechanism to selectively adjust clips 250 and thereby plates or frame 230 relative to frame 210. However, other suitable methods may also be used to draw plates 232 away from the outer edge of frame 210 in order to "stretch" the sheet material to a satisfactory tautness. For example, it is envisioned that one may also utilize cam members, for example, in conjunction with plates members 232 or other suitable adjustable mechanism techniques. The present disclosure is not limited to those specific embodiments described and illustrated herein. It is to be understood as within the scope of the present disclosure to utilize any suitable selective adjustment mechanism which accomplishes the adjustable movement of plates 232 relative to frame 210.

A method is also provided herein for the stretching of a flexible material over a rigid frame and includes providing a first frame assembly having a first and second sides connected by an outer edge and a second frame assembly having first and second sides connected by an outer edge. The stretchable material is mounted over the first side of the first frame assembly and over at least a portion of the second frame assembly. The stretchable material is attached to the second frame assembly. The relative position of the outer edge of the first and second frames are then adjusted from a first position to a second position using a spreading mechanism that includes a threaded rod adjustably positionable in the first frame assembly to move the second frame assembly to stretch the material. This method applies to both embodiments described herein.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the present disclosure.

What is claimed is:

1. A frame system for displaying a sheet of stretchable material comprising:

a first frame assembly defining a first plane, the first frame assembly having a front side and a rear side;

a second frame assembly connected in a substantially parallel relationship to the first frame assembly, the second frame assembly defining a front side and a rear side, the second frame assembly being configured to retain a sheet of stretchable material disposed over the front side of the first frame assembly; and a spreading mechanism connecting the rear side of the first frame assembly with the adjacent front side of the second frame assembly, the spreading mechanism including a plurality of threaded rods which are adjustably positioned in the second frame assembly and abut the first frame assembly so that the first frame assembly is movable through a predetermined range of motion to facilitate selective relative positioning of the first and second frame assemblies in a direction of movement which is substantially perpendicular to a plane generally defined by a sheet of material positioned on the frame system.

2. The frame system for displaying a sheet of stretchable material of claim 1, wherein the movement of the first frame assembly relative to the second frame assembly is at least partially aligned by a plurality of posts.

3. A frame system for stretching material comprising:

a first frame assembly having a plurality of members, the frame assembly defining a front side and a rear side;

a second frame assembly including a plurality of plates each having a flange portion, the plurality of plates slidably positionable substantially on the rear side of the first frame assembly, the plurality of plates configured to be attached to a stretchable material which may be positioned over the front side of the frame assembly; and a plurality of retainig members having a first end portion configured and dimensioned to bias at least one of said plurality of plates in sliding contact with said first frame assembly to move in a substantially non-perpendicular direction relative to a plane defined by the front side of the first frame assembly, wherein the plurality of retaining members are clips positionable over a portion of the first frame and the second frame.

4. The frame system for stretching material of claim 3, wherein each clip includes a threaded rod positioned in a hole defined in the clip for positioning the second frame assembly relative to the first frame assembly.

5. The frame system for stretching material of claim 3, which further includes a lever removably positionable in an opening formed in each of the clips.

6. The frame system for stretching material of claim 5, wherein the lever is used to position a latch on the clip in biasing contact with the second frame assembly.

7. The frame system for stretching material of claim 6, wherein the lever is positioned to detach the clip from biasing contact with the plate so as to permit separation of the plate from the first frame assembly.

8. The frame system for stretching material of claim 3, wherein an adjustment member is positioned between the retaining member and at least one of either the first frame assembly and the plurality of plates, the adjustment member movable through a predetermined range of selected positions to impart movement of the retaining member to selectively adjust the relative positioning of the first frame assembly.

9. A method for positioning a stretchable material over a frame assembly comprising the steps of:

providing a first frame assembly having a first side and a second side connected by an outer edge and a second frame assembly having a first side and a second side connected by an outer edge, the second side of the first frame assembly positioned adjacent the first side of the second frame assembly, the second frame assembly and first frame assembly configured for relative movement;

mounting a stretchable material over a first side of the first frame assembly and over a portion of the second frame assembly and attaching the stretchable material to the second frame assembly; and moving at least one of the firsts or second frame assemblies relative to the other frame assembly from a firsts position of the firsts frame assembly and second frame assembly by adjusting a spreading mechanism operatively associated with each of the first and second frame assemblies, to a second position thereby adjusting the distance between the outer edge of the first frame assembly and the outer edge of the second frame assembly to stretch the material mounted thereon, wherein the step of moving at least one of the first or second frame assemblies includes adjusting a retaining member positioned over at least a portion of the first frame assembly and a portion of the second frame assembly.

10. The method for positioning a stretchable material of claim 9, wherein the step of moving includes slidably moving the outside edge of the second frame member on the second side of the first frame assembly.

11. The method for positioning a stretchable material of claim 9, wherein the step of moving includes repositioning the first frame assembly relative to the second frame assembly in a direction generally perpendicular to a plane at least partially defined by the second frame assembly using the spreading mechanism movably connecting the second side of the first frame assembly with the first side of the second frame assembly.

12. A frame system for stretching material comprising:

a first frame assembly having a plurality of members, the frame assembly defining a front side and a rear side;

a second frame assembly including a plurality of plates each having a flange portion, the plurality of plates slidably positionable substantially on the rear side of the first frame assembly, the plurality of plates configured to be attached to a stretchable material which may be positioned over the front side of the frame assembly;

a plurality of retaining members having a first end portion configured and dimensioned to bias at least one of said plurality of plates in sliding contact with said first frame assembly to move in a substantially non-perpendicular direction relative to a plane defined by the front side of the first frame assembly; and an adjustment member positioned between the retaining member and at least one of either the first frame assembly and the plurality of plates, the adjustment member movable through a predetermined range of selected positions to impart movement of the retaining member to selectively adjust the relative positioning of the first frame assembly.

13. The frame system for displaying a sheet of stretchable material of claim 1, wherein the second frame assembly consists of a first sub-frame and a second sub-frame interconnected by supporting members.

* * * * *